US010415500B2

(12) United States Patent
Rabhi

(10) Patent No.: US 10,415,500 B2
(45) Date of Patent: Sep. 17, 2019

(54) DOUBLE-ACTING PRESSURE REDUCING CYLINDER WITH ADAPTIVE SUPPORT

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 389 days.

(21) Appl. No.: 15/263,965

(22) Filed: Sep. 13, 2016

(65) Prior Publication Data

US 2017/0074295 A1 Mar. 16, 2017

Related U.S. Application Data

(60) Provisional application No. 62/218,252, filed on Sep. 14, 2015.

(51) Int. Cl.

| | |
|---|---|
| ***F15B 15/14*** | (2006.01) |
| ***F02G 1/02*** | (2006.01) |
| ***F02G 1/053*** | (2006.01) |

(52) U.S. Cl.

CPC ..... *F02G 1/02* (2013.01); *F02G 1/053* (2013.01); *F02G 2270/40* (2013.01)

(58) Field of Classification Search

CPC .... F04B 1/0421; F04B 1/0439; F04B 39/121; F04B 53/16; F02B 75/24; F01B 1/08; F01B 7/04; F01B 9/023

See application file for complete search history.

(56) References Cited

U.S. PATENT DOCUMENTS

| | | | | | |
|---|---|---|---|---|---|
| 3,367,240 | A * | 2/1968 | Keppler | F01B 3/0094 | 91/176 |
| 4,887,558 | A * | 12/1989 | Bernard | F01B 3/045 | 123/57.1 |
| 5,228,640 | A * | 7/1993 | Mouille | F16F 13/00 | 188/283 |
| 5,778,835 | A * | 7/1998 | Vought | F02B 75/22 | 123/197.4 |
| 6,279,520 | B1 * | 8/2001 | Lowi, Jr. | F01B 3/045 | 123/56.1 |
| 2006/0288971 | A1 * | 12/2006 | Tasi | F01B 3/0005 | 123/56.1 |
| 2010/0058923 | A1 * | 3/2010 | Green | F01B 3/0002 | 91/480 |

* cited by examiner

*Primary Examiner* — Long T Tran
(74) *Attorney, Agent, or Firm* — Young & Thompson

(57) ABSTRACT

The double-acting pressure reducing cylinder (1) includes a cylinder shaft (71) which cooperates with a double-acting pressure reducing piston (2) connected to transmission elements (3) housed in a transmission casing (8), while a hollow pillar (13) whose ends are articulated is traversed by a rod tunnel and bears against the casing (8) to support the shaft (71), a tie rod (17) likewise articulated traversing the tunnel to clamp the cylinder shaft (71) to the hollow pillar (13), while lower centering elements of the cylinder (20) and upper centering elements of the cylinder (21) integrated with the transmission casing (8) in particular via a centering frame (22) allow the cylinder shaft (71) to move freely in parallel with its longitudinal axis but not in the plane perpendicular to the axis.

20 Claims, 7 Drawing Sheets

DOUBLE-ACTING PRESSURE REDUCING CYLINDER WITH ADAPTIVE SUPPORT

The present invention concerns a double-acting pressure reducing cylinder with adaptive support, said cylinder being able to work at high temperature and be subjected to different thermal expansions from those of the transmission housing to which it is secured.

There should be great interest in the realization of volumetric regeneration engines inspired by Brayton cycle engines with a turbocompressor, driving turbine, burner and regenerator. These engines constitute the primary driving source of certain gas-fired electricity production stations or certain vessels such as those propelled by the Rolls-Royce WR-21 engine.

It will be noted that the applicant holds two French patent applications regarding a transfer/expansion and regeneration thermal engine. The first of these applications was registered on 30 Jan. 2015 as No. 1550762, and the second one is dated 25 Feb. 2015 and carries No. 1551593.

Said engine is distinguished from conventional Brayton cycle regeneration engines in that the driving turbine ordinarily used is replaced by a pressure reducing cylinder whose energy performance is maximized by admission and exhaust metering valves operating by a special mode as described in the "function" section of said applications.

In particular, the phasing of the admission metering valve maximizes the efficiency of the gas expansion by prolonging the latter down to the exhaust pressure. Moreover, the phasing of the exhaust metering valve is designed to recompress the residual exhaust gases trapped in the dead volume situated at the Upper Dead Center of the piston so that, before the admission metering valve opens, the pressure and the temperature of said gases again becomes equivalent to that of the gases leaving the burner. This latter phasing avoids any irreversibility due to the discharging of gases under high pressure into a dead volume remaining at low pressure.

According to said applications, the replacement of said driving turbine with said pressure reducing cylinder is made possible in particular by innovative piston sealing means, which prevents the gases under pressure from escaping between said cylinder and the pressure reducing piston with which it is cooperating. These latter two elements being brought up to very high temperature, they exclude any use of an oil-based lubrication, whether in the form of a segment or a ring, and any contact between the hot pressure reducing cylinder on the one hand, and a sealing segment or gasket on the other hand.

This is why the innovative sealing means proposed in the patent applications No. 1550762 and No. 1551593 make it possible to do without any need for lubrication and contact thanks to a film of air situated between a continuous perforated ring and the pressure reducing cylinder, the flow rate of this air furthermore ensuring a cooling of said ring.

Likewise, said applications propose an unprecedented arrangement and technical solutions which solve a technical problem thus far unsolved, thus meeting the need which has been identified and gone unsolved of making possible the production of regeneration engines with an efficiency much better than that of the turbine type Brayton cycle regeneration engines, and very superior to that of the alternative internal combustion Otto or Diesel thermal engines of whatever type.

It will be noted that, in the applications No. 1550762 and No. 1551593, the sealing means appear in a secondary claim so that the possibility of other sealing means which could provide the same advantages is not ruled out.

This being stated, whether or not it involves the pressure reducing cylinder as presented in the applications No. 1550762 and No. 1551593, or any other pressure reducing cylinder, as long as said cylinder operates at high temperature, it needs to be constituted—like the cylinder head(s) closing off the end(s) and the piston with which it cooperates—of a material having a sufficiently elevated mechanical strength at high temperature, such as aluminum, silicon carbide, or zirconium dioxide. Certain grades of stainless steel or superalloys can also be used. However, their mechanical strength in relation to their price does not necessarily make them the best choice.

The problem is that these elements and materials brought up to temperatures near thousands of degrees Celsius or more are interacting with other elements whose operating temperature remains significantly lower, on the order of only a hundred degrees Celsius. Among said other elements are, for example, the mechanical means of power transmission to which the piston is connected, or the housing enclosing said means and to which the cylinder—whether or not a pressure reducing type—and its head(s) are secured directly or indirectly.

Thus, it must make possible the interworking between these different elements which are connected or secured between them, which operate at different temperatures, and which are possibly constituted of materials whose coefficient of thermal expansion is different.

In particular, the forces produced by the pressure of the gases on the single or double-acting piston must be collected by the mechanical means of transmission so that the latter can provide work in a useful form. Said gases applying the same forces to the cylinder head(s) close the cylinder, and these same forces need to be recovered by a mechanical linkage located between said cylinder head(s) and the housing enclosing the mechanical means of transmission. While each one performs their function, these different elements need to be able to expand and become deformed freely, whether or not in homogeneous manner.

One also notes that, in order to preserve the maximum efficiency for the thermal engine of which they are a part, the hot elements should transfer the least possible heat to the cold elements. This is decisive in the case of the transfer/expansion and regeneration thermal engine of the patent applications No. 1550762 and No. 1551593 belonging to the applicant. In fact, any heat transferred by the hot elements to the cold elements of said engine is irretrievably lost and can no longer be transformed into driving energy.

Now, the fixation of hot parts brought up to high temperature and subjected to elevated forces is preferably accomplished by means of cold steel parts with high mechanical strength. This configuration should not result in an excessive heat transfer from the hot parts to the cold parts.

This is why the double-acting pressure reducing cylinder with adaptive support according to the invention is designed in particular for the alternative volumetric thermal engines with piston and cylinder operating at high temperature, and to meet the triple need of recovering the high forces, allowing the different elements mechanically interconnected and brought up to different operating temperatures to expand and become deformed without compromising their functioning, and limiting the heat transfers from the hot parts to the cold parts.

Moreover, the double-acting pressure reducing cylinder with adaptive support according to the invention is designed to facilitate the realization of alternative engines whose cylinder(s) and piston(s) are for example brought up to temperatures on the order of nine hundred to a thousand degrees Celsius. Such temperatures result from the fact that the cylinder(s) and piston(s) compress and/or expand gases whose temperature may be on the order of eleven hundred to thirteen hundred degrees Celsius, such temperatures being necessary to achieve elevated thermodynamic efficiencies.

In the area of application of alternative thermal machines with piston(s) in general and thermal engines in particular, the invention provides a double-acting pressure reducing cylinder with adaptive support:

whose isotropic or anisotropic expansion can be different from that of the transmission housing to which it is secured, without compromising either the functioning of said cylinder or that of the piston moving in said cylinder, and without significantly altering the volumetric ratio of any thermal engine or thermal machine of which it is a part;

which always remains centered on the piston with which it is cooperating even though the latter may also be brought up to high temperature and be connected to means of transmission operating at low temperature such as the transmission housing in which they are accommodated and to which said cylinder is secured;

which can be integrally secured—as well as its cylinder head(s)—to the transmission housing by means of steel connections with high mechanical strength, and this despite the low temperature required by said steel to maintain its strength, and despite the high temperature to which said cylinder and its head(s) are subjected;

which exports little of its heat to the cold parts with which it is cooperating, thus preserving the efficiency of any thermal engine or any thermal machine of which it is a part;

whose material(s) of which it is made are subjected to a moderate temperature gradient, giving these material(s) an elevated strength and great durability.

It is understood that the double-acting pressure reducing cylinder with adaptive support according to the invention is adaptable to any machine or apparatus having at least one cylinder, whether or not working at high temperature, said cylinder being connected to a casing or housing maintained at low temperature. Among the sample applications of said invention, without limitation, are the transfer/expansion and regeneration thermal engines in the French patent applications No. 1550762 and No. 1551593, which applications belong to the applicant.

The other characteristics of the present invention have been described in the description and in the secondary claims depending directly or indirectly on the main claim.

The double-acting pressure reducing cylinder with adaptive support comprises a cylinder shaft, cooperating with a double-acting pressure reducing piston which is connected by a lower piston rod to means of transmission installed in a transmission casing to which the cylinder shaft is secured, while the end of said shaft which emerges from the side of said means is closed by a lower cylinder head through which the lower piston rod passes via a lower rod opening to define with the double-acting pressure reducing piston a lower chamber of hot gases, while the other end of said shaft is closed by an upper cylinder head to define with said piston an upper chamber of hot gases, and it comprises according to the invention:

At least one hollow pillar through which passes entirely in the direction of its length a rod tunnel, a first pillar end of said pillar resting directly or indirectly on the transmission casing, while a second pillar end of said pillar directly or indirectly supports the cylinder shaft, the lower cylinder head and the upper cylinder head, while said first end can pivot about a ball joint and/or bend in relation to said casing, while said second end can pivot about a ball joint and/or bend in relation to said cylinder shaft;

At least one tie rod, installed in the rod tunnel, a first rod end of said tie rod being directly or indirectly secured to the transmission casing, while a second rod end of said tie rod is secured to the cylinder shaft and/or to the lower cylinder head and/or to the upper cylinder head, said first end being able to pivot about a ball joint and/or bend in relation to said casing, while said second end can pivot about a ball joint and/or bend in relation to said cylinder;

Lower cylinder centering means positioned near the lower cylinder head, said means bearing against the cylinder shaft or the lower cylinder head, on the one hand, and directly or indirectly against the transmission casing on the other hand, and said means leaving the cylinder shaft free to move in parallel with its longitudinal axis in relation to the transmission casing, yet preventing said shaft from moving in the plane perpendicular to said axis, again with respect to said casing;

Upper cylinder centering means positioned near the upper cylinder head, said means bearing against the cylinder shaft or the upper cylinder head, on the one hand, and against a centering frame rigidly fixed to the transmission casing and maintained at a height near that of the upper cylinder head by at least one rigid frame pillar, on the other hand, said means leaving the cylinder shaft free to move in parallel with its longitudinal axis in relation to the transmission casing, yet preventing said shaft from moving in the plane perpendicular to said axis, again with respect to said casing.

The double-acting pressure reducing cylinder according to the present invention comprises at least one rod cooling tube which tightly surrounds the tie rod for all or part of the length of said rod, a cooling fluid coming from a source of cooling fluid being able to circulate in a space left free between the internal wall of said tube and the outer surface of said rod, while the largest possible portion of the outer surface of said tube does not touch the internal wall of the rod tunnel so as to define with the latter wall an empty space.

The double-acting pressure reducing cylinder according to the present invention comprises at least one first tube feed opening which communicates with the interior of the rod cooling tube in the vicinity of the first rod end, and/or at least one second tube feed opening which communicates with the interior of the rod cooling tube in the vicinity of the second rod end, the cooling fluid being able to circulate between the two said openings.

The double-acting pressure reducing cylinder according to the present invention comprises a rod cooling tube which has a tube collar held directly or indirectly clamped by the tie rod either against a fixation lug on the cylinder shaft or the upper cylinder head, or against the transmission casing.

The double-acting pressure reducing cylinder according to the present invention comprises a tube collar which is held clamped by the tie rod against the fixation lug by means of a Banjo fitting, which has at least one radial connection conduit connected to the source of cooling fluid on the one hand, and communicating with the interior of the rod cooling tube on the other hand.

The double-acting pressure reducing cylinder according to the present invention comprises a thermal insulation spacer which is inserted between the tube collar and the fixation lug, said spacer being traversed from one end to the other in the direction of its length by a spacer tunnel in which is installed the tie rod and the rod cooling tube which surrounds it in tight manner, while the largest possible portion of the outer surface of said tube does not touch the internal wall of the spacer tunnel so as to define with the latter wall an empty space.

The double-acting pressure reducing cylinder according to the present invention comprises a rod cooling tube which has at least one tube bulge constituted by an axial portion of said tube whose diameter is essentially equivalent to or slightly greater than that of the rod tunnel in which it is installed.

The double-acting pressure reducing cylinder according to the present invention comprises a rod cooling tube which has at least one constriction of tube diameter constituted by an axial portion of said tube whose diameter is essentially equivalent to or slightly less than that of the body of the tie rod.

The double-acting pressure reducing cylinder according to the present invention comprises a rod cooling tube which has at least one radial communication hole which allows the cooling fluid to enter said tube, or to exit it.

The double-acting pressure reducing cylinder according to the present invention comprises a tie rod which is hollow to form an internal rod cooling channel disposed in the length of said rod, said channel emerging axially or radially from said rod, while a cooling fluid coming from a source of cooling fluid can circulate in said channel.

The double-acting pressure reducing cylinder according to the present invention comprises a pressure chamber which is connected to a source of pressurized air and which is secured by the centering frame or disposed on or in the latter, while an upper piston rod which prolongs the double-acting pressure reducing piston on the side of the upper chamber of hot gases passes through the upper cylinder head via an upper rod opening disposed in said cylinder head and via an access opening to the chamber passing through the centering frame to emerge in the pressure chamber such that the end of said rod which is furthest away from said piston always remains plunged inside said chamber regardless of the position of said piston.

The double-acting pressure reducing cylinder according to the present invention comprises a transmission casing which is topped by a centering and sealing plate, pierced by an access opening to the means of transmission through which passes the lower piston rod in order to be connected to the means of transmission, said plate being rigidly fixed to said casing.

The double-acting pressure reducing cylinder according to the present invention comprises an access opening to the chamber which cooperates with—or which comprises—rod sealing means which provide a seal between said opening and the upper piston rod.

The double-acting pressure reducing cylinder according to the present invention comprises an access opening to the means of transmission which cooperates with—or which comprises—rod sealing means which provide a seal between said opening and the lower piston rod.

The double-acting pressure reducing cylinder according to the present invention comprises rod sealing means which include an upper rod seal and a lower rod seal sufficiently distant from each other to form—between the two said seals—an oil circulation chamber into which empties a conduit for supply of cooling and lubricating oil and from which emerges an outlet conduit for cooling and lubricating oil.

The double-acting pressure reducing cylinder according to the present invention comprises rod sealing means which cooperate with a rod guide bushing installed inside or outside of the oil circulation chamber.

The double-acting pressure reducing cylinder according to the present invention comprises lower centering means of the cylinder and/or upper centering means of the cylinder which are comprised by an elastic centering disk which can be pierced at its center by a disk hole through which passes, respectively, the lower piston rod or an upper piston rod, while its periphery is comprised of a disk fixation collar secured in tight manner respectively to the transmission casing and/or to the centering frame.

The double-acting pressure reducing cylinder according to the present invention comprises a centering and sealing plate which carries the lower centering means of the cylinder, being comprised of an elastic centering disk whose periphery forms a disk fixation collar, secured in tight manner to said plate, said disk being pierced at its center by a disk hole through which passes the lower piston rod without touching said disk, the edge of the disk hole having a circular contact pad which is maintained in tight contact with a centering and sealing cone on the lower cylinder head, said cone being either male or female, and the contact between said pad and said cone having the effect of deforming the elastic centering disk axially and from its center.

The double-acting pressure reducing cylinder according to the present invention comprises upper centering means of the cylinder, which are comprised of an elastic centering disk whose periphery forms a disk fixation collar, secured in tight manner to the centering frame, said disk being pierced at its center by a disk hole whose edge has a circular contact pad which is maintained in tight contact with a centering and sealing cone on the upper cylinder head, said cone being either male or female, and the contact between said pad and said cone having the effect of deforming the elastic centering disk axially and from its center.

The following description with regard to the enclosed drawings, given as nonlimiting examples, will make it possible to better comprehend the invention, the characteristics which it presents, and the advantages which it is able to provide:

FIG. 1 is a three-dimensional and three-quarter view of the double-acting pressure reducing cylinder according to the invention, and of the transmission casing to which it is attached.

FIG. 2 is a three-dimensional front and cutaway view of the double-acting pressure reducing cylinder according to the invention, said view likewise representing the transmission casing to which is secured the cylinder shaft, as well as the double-acting pressure reducing piston and the means of transmission housed in said casing, said means being constituted according to this sample embodiment by a link articulated to a crank connected to a crankshaft, and a crosshead.

DESCRIPTION OF THE INVENTION

We have shown in FIGS. 1 to 7 the double-acting pressure reducing cylinder 1 with adaptive support, various details of its components, its variants, and its accessories.

Figure 1:
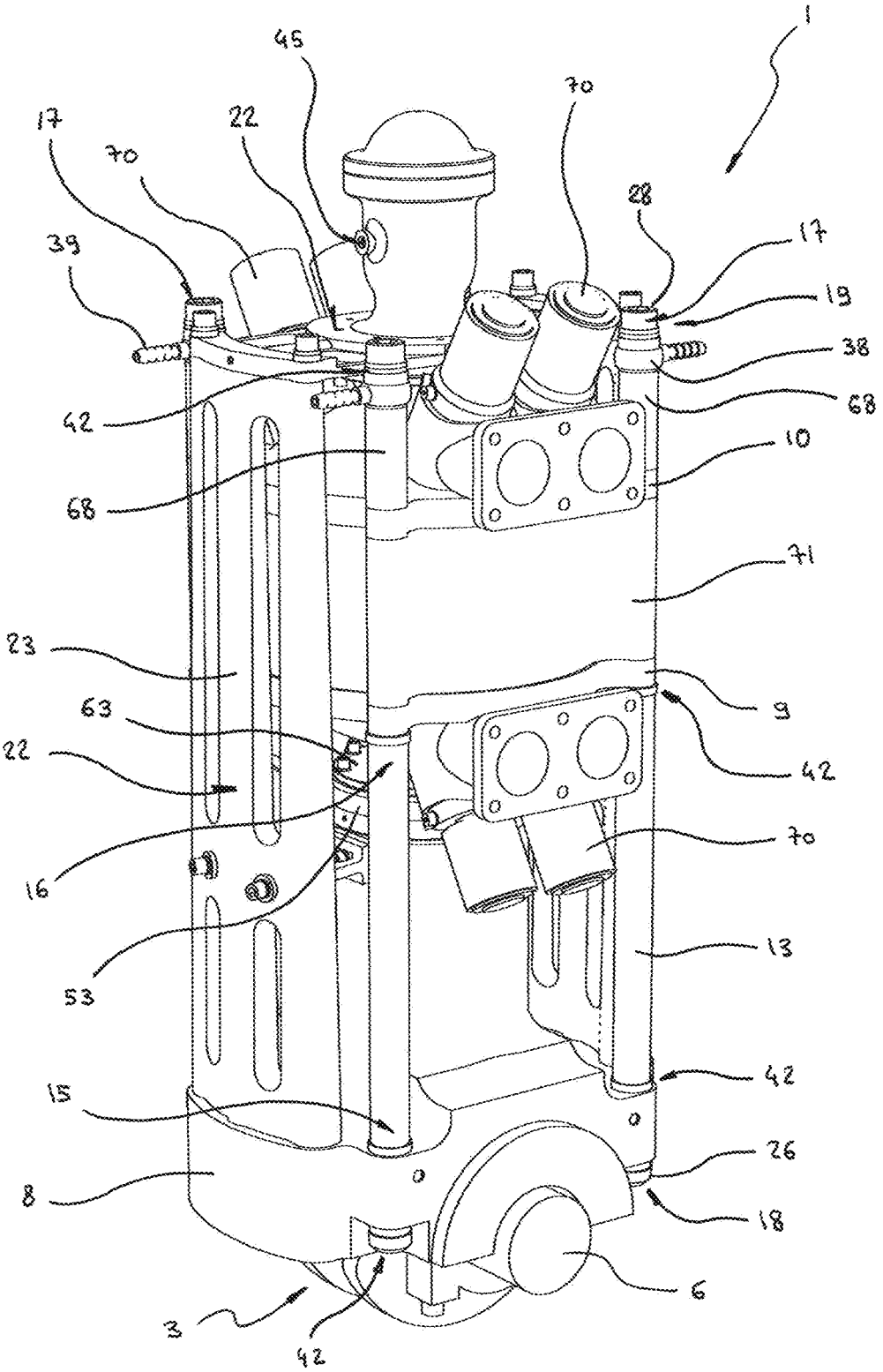
Figure 2:
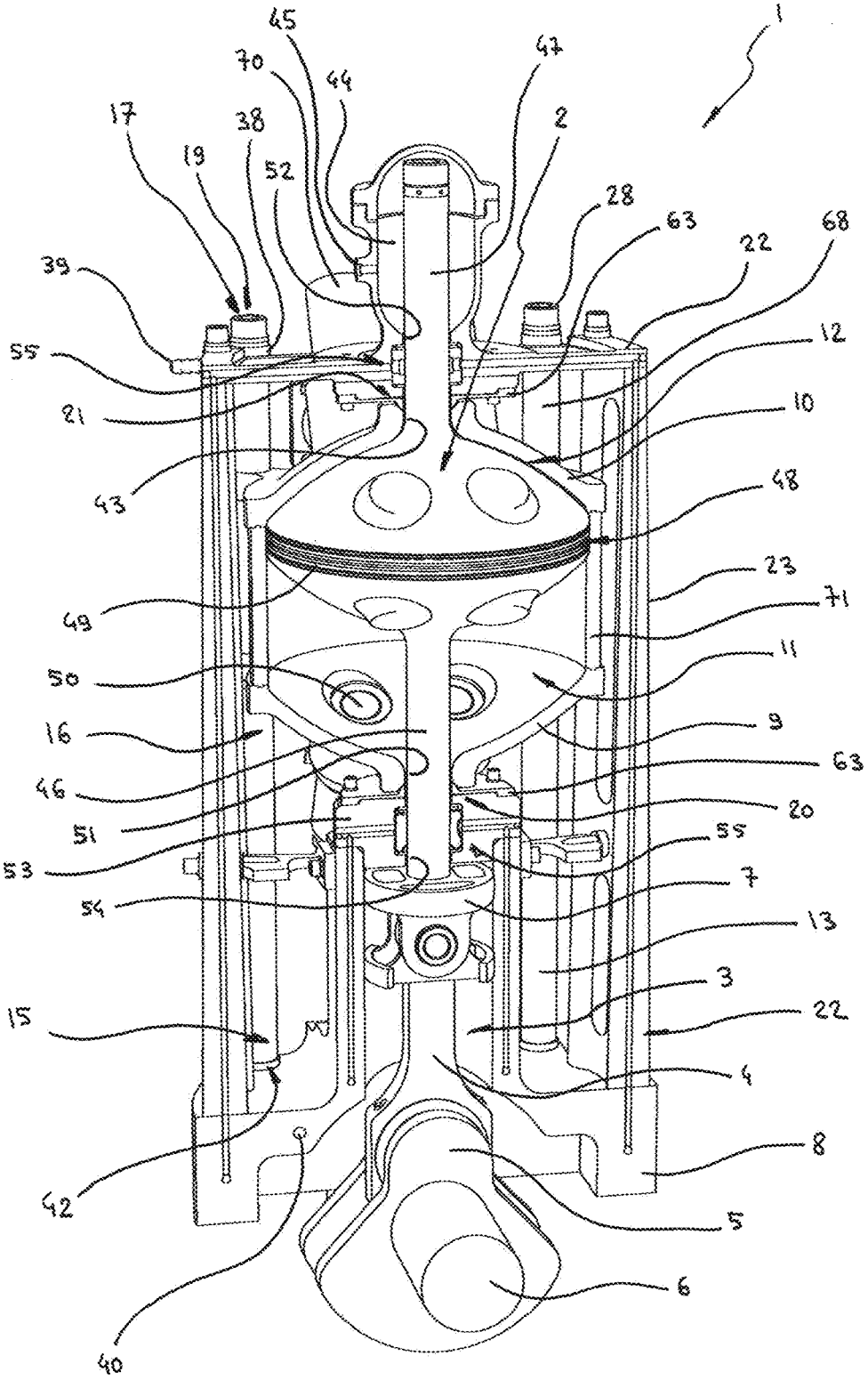
Figure 3:
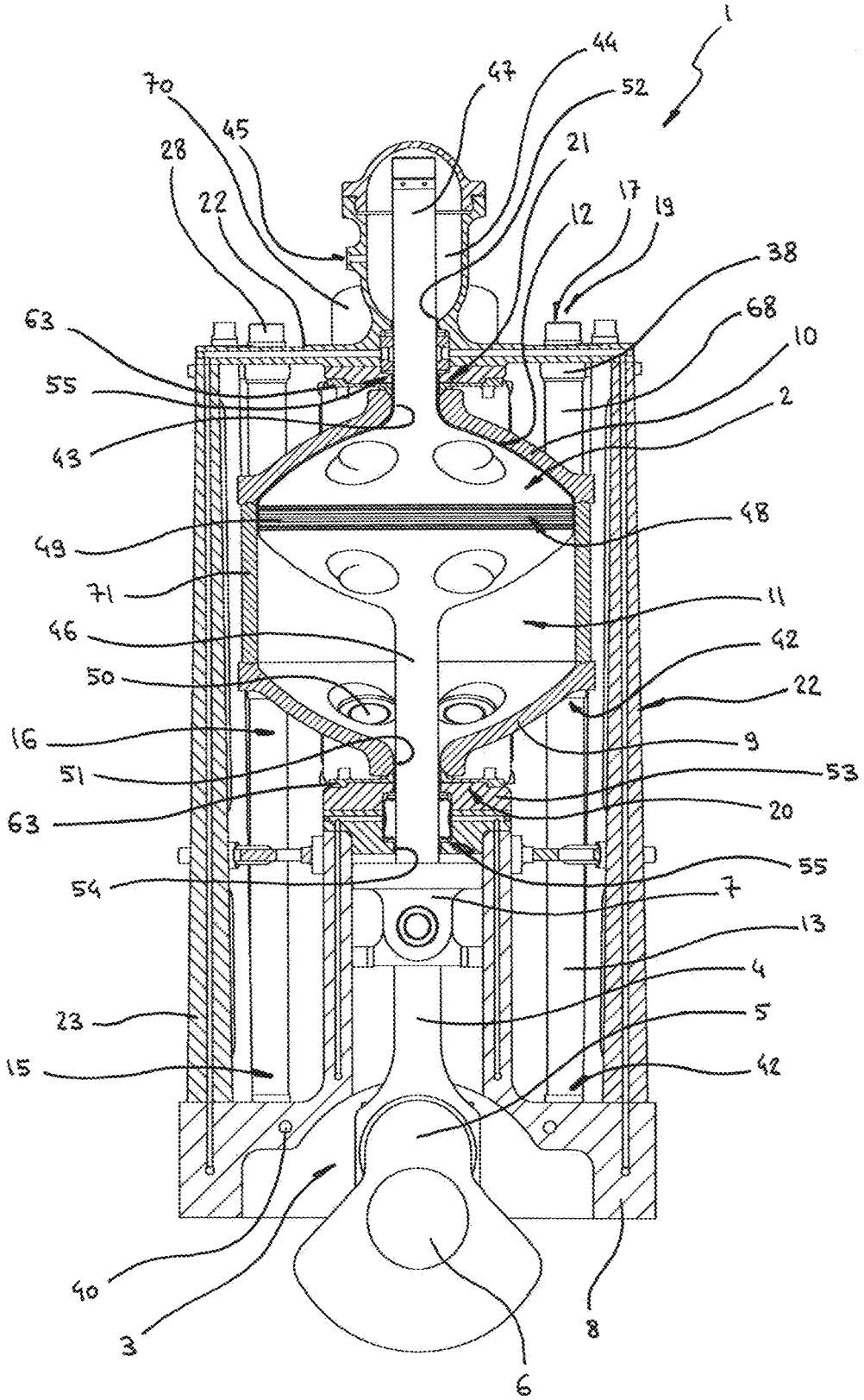
FIG. 3 is a schematic longitudinal view of the double-acting pressure reducing cylinder according to the invention in an embodiment variant identical to that of FIG. 2.
Figure 4:
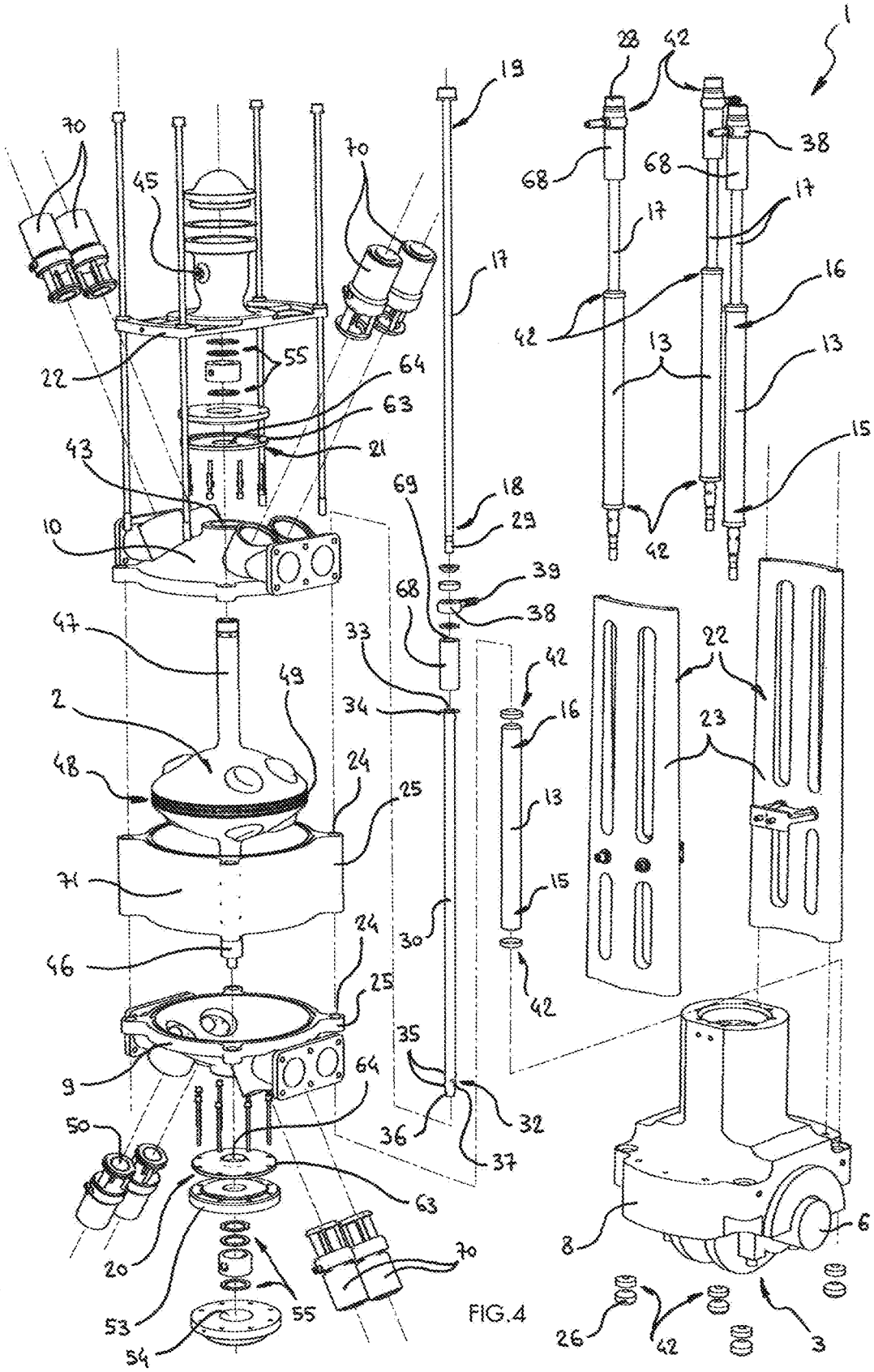
FIG. 4 is a three-dimensional exploded view of the double-acting pressure reducing cylinder according to the invention, and in a variant embodiment identical to that presented in FIG. 2.

As shown clearly by FIGS. 2 to 4, the double-acting pressure reducing cylinder 1 comprises a cylinder shaft 71 cooperating with a double-acting pressure reducing piston 2 which is connected by a lower piston rod 46 to means of transmission 3 which can be comprised, for example, of a link articulated on a crank 5 which is arranged on a crankshaft 6, said link 4 being connected to the double-acting pressure reducing piston 2 directly by a piston axis or indirectly through a crosshead 7.

It will be noted that, as an alternative, said means 3 could also be constituted of a cam, a hydraulic output pump, an electricity generator, or any other means of transmission known to the skilled person.

One notes that—as illustrated by FIGS. 1 to 5—the means of transmission 3 are housed in a transmission casing 8 maintained at low temperature, to which is secured the cylinder shaft 71, this latter and the double-acting pressure reducing piston 2 being able for their part to operate at high temperature.

One notes, again in FIGS. 1 to 5, that the end of the cylinder shaft 71 which emerges on the side of said means 3 is closed by a lower cylinder head 9 through which passes the lower piston rod 46 via a lower rod opening 51 to define with the double-acting pressure reducing piston 2 a lower chamber of hot gases 11, while the other end of said shaft 71 is closed by an upper cylinder head 10 to define with said piston 2 an upper chamber of hot gases 12, the lower cylinder head 9 and the upper cylinder head 10 being able to have at least one valve 50 controlled by a valve actuator 70.

FIGS. 1 to 5 also show that the double-acting pressure reducing cylinder 1 with adaptive support according to the invention comprises at least one hollow pillar 13 traversed from one end to the other in the direction of its length by a rod tunnel 14 which can be either totally closed or perforated.

One will notice that a first pillar end 15 of the hollow pillar 13 rests directly or indirectly on the transmission casing 8, while a second pillar end 16 of said pillar 13 supports directly or indirectly the cylinder shaft 71, the lower cylinder head 9 and the upper cylinder head 10.

Moreover, the double-acting pressure reducing cylinder 1 with adaptive support according to the invention calls for the first pillar end 15 being able to pivot about a ball joint 42 and/or bend in relation to said casing 8, while the second pillar end 16 can pivot about a ball joint 42 and/or bend in relation to said cylinder shaft 71, the pivoting of said ends 15, 16 being able to occur either by means of a mechanical link of pivot or Cardan type or a ball joint 42, or by the bending of some or all of the hollow pillar 13, or by both means.

According to one particular realization of the double-acting pressure reducing cylinder 1 according to the invention, the hollow pillar 13 can be made of zirconium dioxide, or "zircon", this ceramic offering a good mechanical strength at high temperature, a slight thermal conductivity, and a coefficient of expansion near that of steel.

It is noted that, advantageously, in order to prevent the volumetric ratio of the lower chamber of hot gases 11 and the upper chamber of hot gases 12 from varying too much during the heating of the cylinder shaft 71, the latter can rest on the second pillar end 16 approximately at the height of the double-acting pressure reducing piston 2 when the latter is positioned halfway in its travel. Thus, when the cylinder shaft 71 expands under the effect of its temperature rise, the lower cylinder head 9 and the upper cylinder head 10 move away approximately by the same distance in relation to the median position of the double-acting pressure reducing piston 2.

FIGS. 1 to 5 likewise illustrate that the double-acting pressure reducing cylinder 1 with adaptive support according to the invention comprises at least one tie rod 17 installed in the rod tunnel 14, a first rod end 18 of said tie rod 17 being secured directly or indirectly to the transmission casing 8, while a second rod end 19 of said tie rod 17 is secured to the cylinder shaft 71 and/or to the lower cylinder head 9 and/or to the upper cylinder head 10, said first end 18 being able to pivot about a ball joint 42 and/or bend in relation to said casing 8, while said second end 19 can pivot about a ball joint 42 and/or bend in relation to said cylinder 1.

It is noted that the pivoting of said ends 18, 19 can occur either by means of a mechanical link of the pivot or Cardan type or a ball joint 42, or by the bending of all or part of the tie rod 17, or by both.

It will be noted that in order to be secured to the cylinder shaft 71 and/or to said cylinder heads 9, 10, the second rod end 19 can pass through a lug opening 24 of a fixation lug 25 on said shaft 71 and/or said cylinder heads 9, 10, while either a rod head 28 or a rod nut 26 screwed onto a rod thread 29 arranged on the tie rod 17 bears against said lug 25 so as to clamp the latter between said head 28 or said nut 26, and the hollow pillar 13.

It will further be noted that the first rod end 18 can be secured to the transmission casing 8 likewise by means of a rod head 28, or a rod nut 26 screwed onto a rod thread 29. Alternatively, said rod thread 29 can be screwed into a thread 27 directly or indirectly made in the transmission casing 8.

According to one particular realization of the double-acting pressure reducing cylinder 1 according to the invention, a compression spring can be inserted either between the rod head 28 or the rod nut 26 and the fixation lug 25, or between said head 28 or any other threaded part in which is screwed the rod thread 29, and any other supporting part. Said compression spring can be comprised, for example, of one or more Belleville washers.

Such a compression spring can limit in particular the tension to which the tie rod 17 is subjected when the various elements which it is clamping together expand under the effect of their rise in temperature. In any case, advantageously the cylinder shaft 71, the lower cylinder head 9 and the upper cylinder head 10 should be preferably covered at least with a thermal shield which limits the emission of heat from these elements 71, 9 and 10 in the surroundings, said shield being constituted for example of several layers of metal foil of slight thickness having pegs which leave a film of air between each such foil, or be constituted in any other way suitable to thermal shields and known to the skilled person.

It will be noted as a technical equivalent and variant of the double-acting pressure reducing cylinder 1 according to the invention, that the tie rod 17 can be juxtaposed with the hollow pillar 13 which in this case need not be traversed from one end to the other in the direction of its length by a rod tunnel 14 since the same function of said rod 17 and said pillar 13 remains unchanged and the ball joints 42 with which said rod 17 and said pillar 13 cooperate produce the same effects.

FIGS. 2, 3, 4 and 6 show in obvious manner that the double-acting pressure reducing cylinder 1 according to the invention comprises lower centering means of the cylinder 20 positioned in the vicinity of the lower cylinder head 9, said means 20 bearing against the cylinder shaft 71 or the lower cylinder head 9 on the one hand, and directly or indirectly on the transmission casing 8 on the other hand, and said means 20 leave the cylinder shaft 71 free to move in parallel with its longitudinal axis in relation to the transmission casing 8, but prevent said shaft 71 from moving in the plane perpendicular to said axis, again in relation to said casing 8.

FIGS. 2, 3, 4 et 7 illustrate that the double-acting pressure reducing cylinder 1 according to the invention also has upper centering means of the cylinder 21 positioned in the vicinity of the upper cylinder head 10, said means 21 bearing against the cylinder shaft 71 or the upper cylinder head 10 on the one hand, and against a centering frame 22 rigidly fixed to the transmission casing 8 and maintained at a height close to that of the upper cylinder head 10 by at least one rigid frame pillar 23 on the other hand, said means 21 leaving the cylinder shaft 71 free to move in parallel with its longitudinal axis in relation to the transmission casing 8, but preventing said shaft 71 from moving in the plane perpendicular to said axis, again in relation to said casing 8.

Figure 5:
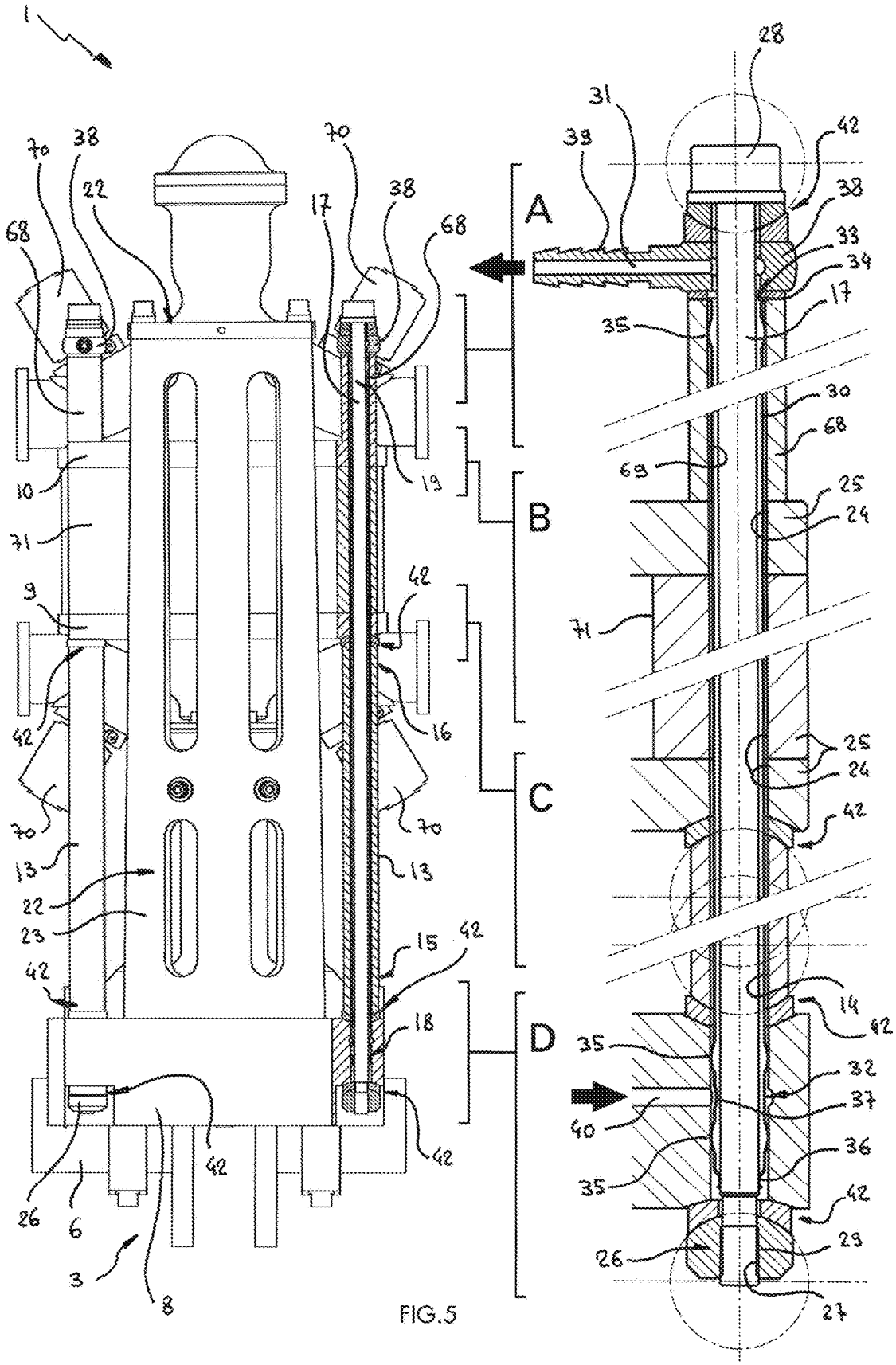
FIG. 5 is a lateral view of the double-acting pressure reducing cylinder according to the invention showing by means of a cross section the particular configuration of the hollow pillar, the tie rod, and the various ball joints with which these two elements cooperate, said cross section being magnified and sectioned in the right-hand portion of the figure to facilitate comprehension.

FIGS. 4 and 5 show at least one rod cooling tube 30 which can be comprised in the double-acting pressure reducing cylinder 1 according to the invention, said tube 30 surrounding in tight manner the tie rod 17 for all or some of the length of said rod 17, a cooling fluid 31 coming from a source of cooling fluid 40 being able to circulate in a space left free between the internal wall of said 30 and the outer surface of said rod 17, while the largest possible portion of the outer surface of said tube 30 does not touch the internal wall of the rod tunnel 14 so as to define with this latter wall an empty space.

FIGS. 4 and 5 show that the double-acting pressure reducing cylinder 1 according to the invention can comprise at least a first tube supply opening 32 communicating with the interior of the rod cooling tube 30 in the vicinity of the first rod end 18, and/or at least one second tube supply opening 33 communicating with the interior of the rod cooling tube 30 in the vicinity of the second rod end 19, the cooling fluid 31 being able to circulate between the two said openings 32, 33, while said fluid 31 is colder when it enters the rod cooling tube 30 than when it leaves.

It is noted that a fluid pump, not shown, can be provided to force the cooling fluid 31 to circulate in the rod cooling tube 30, said pump being able to continue functioning for a certain time after the stoppage of the thermal machine in which the double-acting pressure reducing cylinder 1 according to the invention is applied.

This latter arrangement makes it possible, for example, to evacuate the heat which the cylinder shaft 71 and its cylinder heads 9, 10 are liable to continue transmitting during their cooldown to the tie rod 17. It is noted, furthermore, that once leaving the rod cooling tube 30, the cooling fluid 31 can be cooled by a heat exchanger before being taken once more to said 30, or replenished.

Again in FIGS. 4 and 5 one notes that the rod cooling tube 30 can comprise a tube collar 34 held directly or indirectly clamped by the tie rod 17 either against a fixation lug 25 on the cylinder shaft 71 or the upper cylinder head 10, or against the transmission casing 8.

According to one particular variant embodiment of the double-acting pressure reducing cylinder 1 according to the invention, the tube collar 34 can be held clamped by the tie rod 17 against the fixation lug 25 by means of a Banjo fitting 38 having at least one radial connection conduit 39 connected to the source of cooling fluid 40 on the one hand, and communicating with the interior of the rod cooling tube 30 on the other hand.

It is noted that the radial connection conduit 39 can be connected to the source of cooling fluid 40 or to other radial connection conduits 39 of the Banjo fitting 38 for other rod cooling tubes 30 by means of a flexible or deformable conduit which can adapt to changes in distance caused by the thermal expansion of the different elements making up the double-acting pressure reducing cylinder 1 according to the invention.

As will be noticed in FIGS. 1 to 5, a thermal insulation spacer 68 can be inserted between the tube collar 34 and the fixation lug 25, said spacer 68 being traversed from one end to the other in the direction of its length by a spacer tunnel 69 in which is housed the tie rod 17 and the rod cooling tube 30 surrounding it in tight manner, while the largest possible portion of the outer surface of said tube 30 does not touch the internal wall of the spacer tunnel 69 so as to define with this latter wall an empty space.

It is noted that the thermal insulation spacer 68 can advantageously be realized of a material resistant to elevated temperatures and presenting a low thermal conductivity, such as zirconium dioxide.

FIGS. 4 and 5 show that the rod cooling tube 30 can comprise at least one tube bulge 35 constituted by an axial portion of said tube 30 whose diameter is substantially equivalent to or slightly larger than that of the rod tunnel 14 in which it is installed, thus guaranteeing that said tube 30 remains locally centered in said tunnel 14, and realizing if necessary a seal between said tube 30 and said tunnel 14.

The rod cooling tube 30 can moreover comprise at least one constriction in diameter of the tube 36 comprised of an axial portion of said tube 30 whose diameter is substantially equivalent to or slightly less than that of the body of the tie rod 17 in order to realize locally a seal between said tube 30 and said rod 17.

It will also be noted, as illustrated in FIGS. 4 and 5, that the rod cooling tube 30 can also have at least one radial communication hole 37 allowing the cooling fluid 31 to enter said 30, or to exit from it.

As a variant, not represented, one will note that the tie rod 17 can be hollow to form an internal rod cooling channel disposed in the length of said rod 17, said channel emerging axially or radially from said rod 17, while a cooling fluid 31 coming from a source of cooling fluid 40 can circulate in said channel 41.

Figure 7:
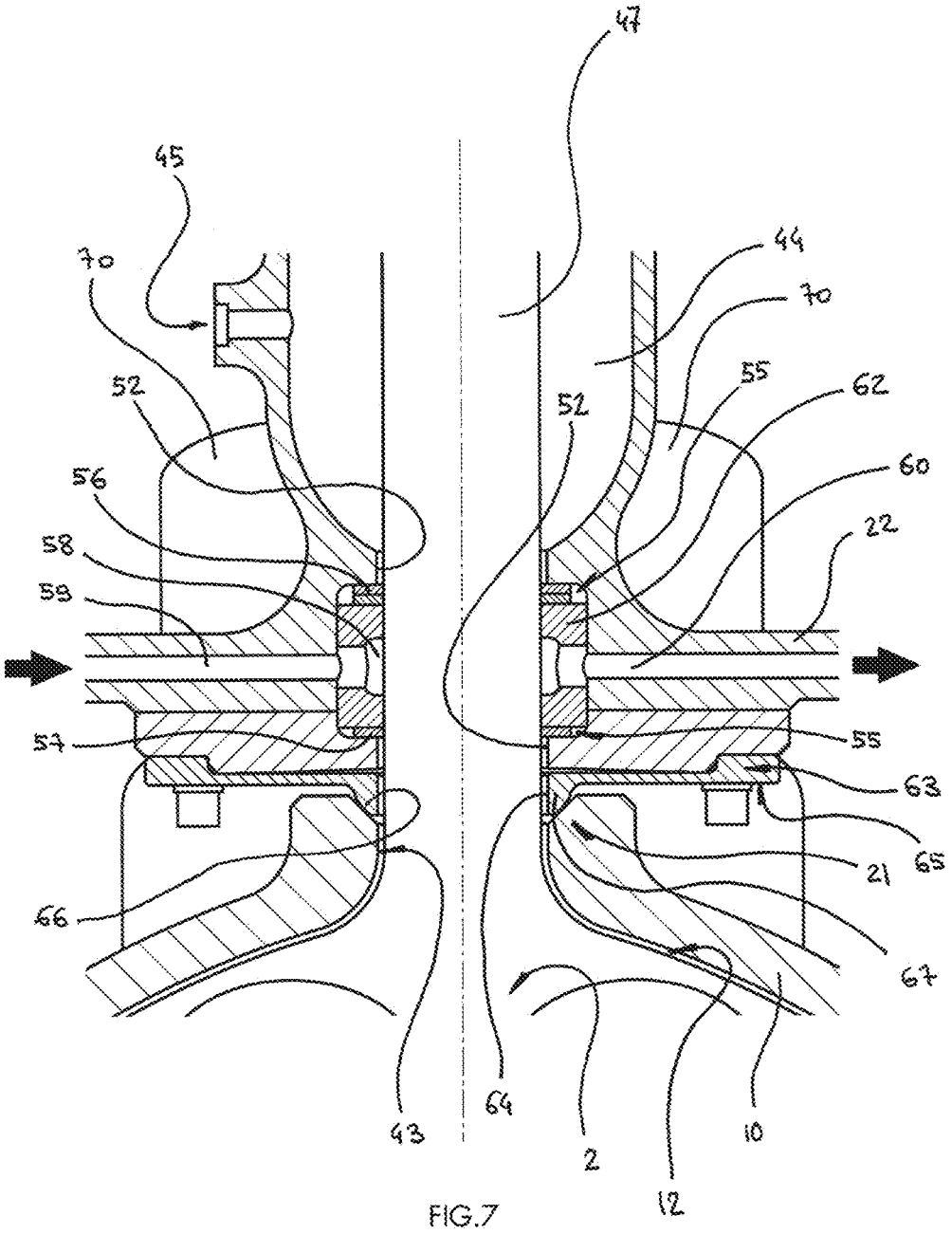
FIG. 7 is a schematic cross sectional view of a portion of the centering frame of the double-acting pressure reducing cylinder according to the invention, of the elastic centering disk secured to said frame, and of the rod sealing means which cooperate with the upper piston rod which emerges—according to this particular sample embodiment—into a pressure chamber.

FIGS. 2, 3 and 7 show clearly that the double-acting pressure reducing cylinder 1 according to the invention can comprise a pressure chamber 44 connected to a source of pressurized air 45 and which is secured to the centering frame 22 or disposed on or in the latter, while an upper piston rod 47 which prolongs the double-acting pressure reducing piston 2 on the side of the upper chamber of hot gases 12 traverses the upper cylinder head 10 via an upper rod opening 43 disposed in said cylinder head 10 and via an access opening to the chamber 52 passing through the centering frame 22 to emerge into the pressure chamber 44 such that the end of said rod 47 which is furthest away from said piston 2 always remains plunged into said chamber 44 regardless of the position of said piston 2.

This particular configuration of the double-acting pressure reducing cylinder 1 according to the invention makes it possible, for example, to supply compressed air—especially via the pressure chamber 44 and an internal channel of the upper piston rod 47—for sealing means 48 such as a continuous perforated ring 49 with an air cushion, housed in a ring groove disposed in the periphery of the double-acting pressure reducing piston 2, said means 48 possibly being similar or identical to those specified in the French patent applications No. 1550762 and No. 1551593 belonging to the applicant and enabling the realization of a transfer/expansion and regeneration thermal engine.

FIGS. 1 to 4 and FIG. 6 show that the transmission casing 8 can be topped by a centering and sealing plate 53 pierced by an access opening to the means of transmission 54 through which passes the lower piston rod 46 in order to be connected to the means of transmission 3, said plate 53 being rigidly fixed to said casing 8 by screws or by any other means known to the skilled person. Alternatively, said plate 53 can be an integral part of said casing 8.

In FIGS. 2, 3 and 7 it will be noted that the access opening to the chamber 52 can cooperate with—or comprise—rod sealing means 55 which produce a seal between said opening 52 and the upper piston rod 47.

Figure 6:
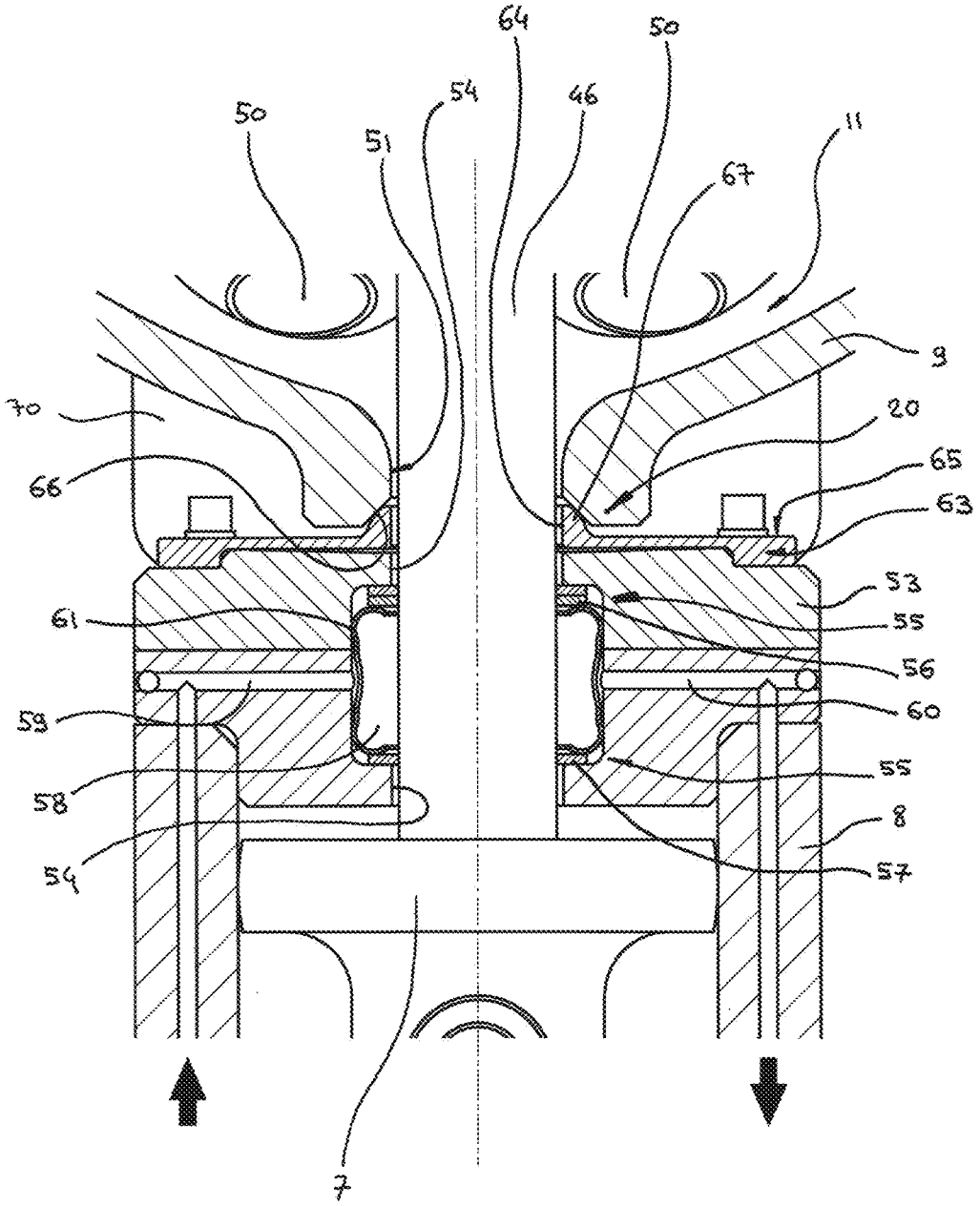
FIG. 6 is a schematic cross sectional view of the centering and sealing plate of the double-acting pressure reducing cylinder according to the invention, of the elastic centering disk, and of the rod sealing means, the latter cooperating with the lower piston rod.

In similar fashion, FIGS. 2, 3 and 6 shows that the access opening to the means of transmission 54 can cooperate with—or comprise—rod sealing means 55 which produce a seal between said opening 54 and the lower piston rod 46.

It is FIGS. 6 and 7 which illustrate most clearly that the rod sealing means 55 can comprise an upper rod seal 56 and a lower rod seal 57 sufficiently far apart from each other to form—between the two said seals 56, 57—an oil circulation chamber 58 into which empties a supply line for cooling and lubricating oil 59 and from which emerges an outlet line for cooling and lubricating oil 60.

It will be noted in said figures that the oil circulation chamber 58 provides the dual function of lubricating and cooling of the lower piston rod 46 and/or the upper piston rod 47. It is further noted that the upper rod seal 56 and/or the lower rod seal 57 can be comprised in particular of a section of a ring or two sections of a ring that are superimposed and set off by angle such that the outer surface of the lower piston rod 46 and/or the upper piston rod 47 can be provided with radii of slight depth in a double helix pattern which produce a series of oil reservoirs and hydrodynamic lift surfaces.

In FIG. 6 one notes that the ring(s) comprising the upper rod seal 56 can be kept at a distance from those making up the lower rod seal 57 by a ring spacing spring 61, which is likewise designed—especially because it has openings or passages—to let through the flow of cooling and lubricating oil established between the supply line for lubricating and cooling oil 59 and the outlet line for lubricating and cooling oil 60.

In FIG. 7 one sees that the rod sealing means 55 can cooperate with a rod guide bushing 62 housed inside or outside the oil circulation chamber 58, said bushing 62 being made of bronze or any other material commonly used to make antifriction and/or hydrodynamic bearings or bushings, while said bushing 62 ensures the radial guidance of the lower piston rod 46 in the access opening to the means of transmission 54 and/or the upper piston rod 47 in the access opening to the chamber 52.

It is noted furthermore that, if the means of transmission 3 comprise a crosshead 7, the rod sealing means 55 are preferably provided with a rod guide bushing 62 when applied to the upper piston rod 47, whereas the radial guidance of the lower piston rod 46 is provided by said crosshead 7 alone.

In FIGS. 2 to 4 and in FIGS. 6 and 7 one notes that, in a particular configuration of the double-acting pressure reducing cylinder 1 according to the invention, the lower centering means of the cylinder 20 and/or the upper centering means of the cylinder 21 can be comprised of an elastic centering disk 63 which may be pierced at its center by a disk hole 64 through which passes respectively the lower piston rod 46 or an upper piston rod 47, while its periphery constitutes a disk fixation collar 65 secured in tight manner to the transmission casing 8 and/or to the centering frame 22.

FIGS. 2 to 4 and FIG. 6 show that the centering and sealing plate 53 can carry the lower centering means of the cylinder 20 which are comprised of an elastic centering disk 63 whose periphery forms a disk fixation collar 65 secured in tight manner to said plate 53, said disk 63 being pierced at its center by a disk hole 64 through which passes the lower piston rod 46 without touching said disk 63, the edge of the disk hole 64 having a circular contact pad 67 which is held in tight contact with a centering and sealing cone 66 on the lower cylinder head 9, said cone 66 being male or female, and the contact between said pad 67 and said cone 66 having the effect of deforming the elastic centering disk 63 axially and from its center.

One notes that the disk fixation collar 65 can be secured to the centering and sealing plate 53 by means of at least one screw, a clip, or any other fixation means known to the skilled person. It is noted that advantageously the elastic centering disk 63 can be made of a material resistant to elevated temperatures and presenting a low thermal conductivity, such as zirconium dioxide.

As an alternative, the elastic centering disk 63 can be fixed to the lower cylinder head 9, while the centering and sealing cone 66 is disposed on or in the centering and sealing plate 53.

In similar manner, one notes in FIGS. 2 to 4 and in FIG. 7 that the upper centering means of the cylinder 21 can be comprised of an elastic centering disk 63 whose periphery forms a disk fixation collar 65 secured in tight manner to the centering frame 22, said disk 63 being pierced at its center by a disk hole 64 whose edge has a circular contact pad 67 which is held in tight contact with a centering and sealing cone 66 on the upper cylinder head 10, said cone 66 being male or female, and the contact between said pad 67 and said cone 66 having the effect of deforming the elastic centering disk 63 axially and from its center.

It will be noted that the disk fixation collar 65 can be secured to the centering frame 22 by means of at least one screw, a clip, or any other fixation means known to the skilled person.

It is also noted that if the double-acting pressure reducing piston 2 is prolonged—on the side of the upper chamber of hot gases 12—by an upper piston rod 47, this latter passes through the disk hole 64 without touching the elastic centering disk 63.

It will be noted furthermore that advantageously the elastic centering disk 63 can be made of a material resistant to elevated temperatures and presenting a low thermal conductivity, such as zirconium dioxide.

As an alternative, the elastic centering disk 63 can be fixed to the upper cylinder head 10, while the centering and sealing cone 66 is disposed on or in the centering frame 22.

One can also note that, as an alternative to what has just been described, and whether involving lower centering means of the cylinder 20 or upper centering means of the cylinder 21, a contact pad similar to that of the disk hole 64 can be devised respectively on either the lower cylinder head 9 or the upper cylinder head 10, while a centering and sealing cone similar to that of said cylinder heads 9, 10 is devised on and/or in the elastic centering disk 63.

It is noted that, as a variant, the elastic centering disk 63 can be comprised for example of a steel or superalloy torus, whether or not slit, of an expansible washer whether or not having multiple folds, stacked radially and made from the same piece of metal or ceramic, of at least three pins driven by a spring, spaced apart by one hundred twenty degrees each and cooperating with a sealing ring, and in general any technical solution able to provide a centering and a sealing under the desired operating conditions, while limiting the heat losses from any hot part to any cold part.

Functioning of the Invention

The functioning of the double-acting pressure reducing cylinder 1 with adaptive support according to the invention will be easily understood by looking at FIGS. 1 to 7.

In order to describe this functioning, let us assume here that the double-acting pressure reducing cylinder 1 is being used in the transfer/expansion and regeneration thermal engine whose French patent applications No. 1550762 and No. 1551593 belong to the applicant. This application is merely an example and in no way excludes any other use of the double-acting pressure reducing cylinder 1 according to the invention.

When said engine is started, the cylinder shaft 71 of the double-acting pressure reducing cylinder 1 according to the invention quickly rises in temperature as compared to the transmission casing 8 to which it is secured, said casing 8 housing the means of transmission 3. The same is true for the double-acting pressure reducing piston 2 cooperating with said shaft 71, as well as for the lower cylinder head 9 which closes the end of the shaft 71 on the side of the means of transmission 3, and for the upper cylinder head 10 which closes the other end of the shaft 71.

It is noted in FIGS. 2 and 3 that, in the particular sample embodiment of the double-acting pressure reducing cylinder 1 according to the invention presented there, the means of transmission 3 are provided in order to transform the reciprocating movements in the cylinder shaft 71 of the double-acting pressure reducing piston 2 into a continuous rotation movement of a crankshaft 6. For this purpose, and again according to this nonlimiting example, said means 3 are comprised of a link 4 connected to the double-acting pressure reducing piston 2 by means of a crosshead 7, said link 4 being articulated about a crank 5 disposed on the crankshaft 6.

It will be assumed here that the temperature of the cylinder shaft 71, the double-acting pressure reducing piston 2, the lower cylinder head 9 and the upper cylinder head 10 reaches, for example, nine hundred degrees Celsius, while the temperature of the transmission casing 8 and the means of transmission 3 which it houses remains limited to one hundred degrees Celsius.

The elevated temperature of said shaft 71, said piston 2, and said cylinder heads 9, 10 is need to provide the transfer/expansion and regeneration thermal engine with the best possible efficiency, while the maintaining of the transmission casing 8 and the means of transmission 3 at relatively low temperature is necessary in order for them to maintain an elevated mechanical strength and the lubrication of the various elements of which they are composed to be possible without risk of coking of any lubricating oil.

It is noted that the cylinder shaft 71, the double-acting pressure reducing piston 2, the lower cylinder head 9 and the upper cylinder head 10 are produced, for example, primarily of silicon carbide, which has an elevated mechanical strength at high temperature, whereas the transmission casing 8 can be made of aluminum and the means of transmission 3 can be made of cast iron or steel.

Even though the coefficient of thermal expansion of silicon carbide is less than that of aluminum or steel, the components brought up to nine hundred degrees Celsius expand more than those brought up to only one hundred degrees Celsius. It is thus necessary to allow the components made of silicon carbide to expand freely as compared to those made of aluminum, cast iron, or steel, without inducing an excessive mechanical stress in either the silicon carbide or in the other materials.

It should be possible to do this while still guaranteeing that the forces applied to the double-acting pressure reducing piston 2 by the pressure prevailing alternately in the lower chamber of hot gases 11 and then in the upper chamber of hot gases 12 are properly transmitted by the lower piston rod 46 to the link 4 via the crosshead 7.

It is noted that said forces tend to move the cylinder shaft 71 away from the transmission casing 8 when the gas pressure is high in the upper chamber of hot gases 12, the double-acting pressure reducing piston 2 exerting a compression force of comparable intensity on the link 4, while said forces tend to bring said shaft 71 closer to said casing 8 when the gas pressure is high in the lower chamber of hot gases 11, said piston 2 exerting a traction force of comparable intensity on the link 4.

In order to recover these traction and compression forces applied to the cylinder shaft 71 and more precisely to the lower cylinder head 9 and the upper cylinder head 10, with which it cooperates, said shaft 71 is connected to the transmission casing 8 by hollow pillars 13 as represented in FIGS. 1 to 5 and which are four in number—as a nonlimiting example—which can be easily counted in FIG. 4.

As illustrated in especially obvious manner in FIG. 5, each hollow pillar 13 has two ball joints 42 to which it is hinged. One notes in zone D of said FIG. 5 that between the first pillar end 15 of said pillar 13 and the transmission casing 8 there is installed a first ball joint 42, while zone C of the same FIG. 5 shows that between the second pillar end 16 of said pillar 13 and the lower cylinder head 9 there is installed a second ball joint 42.

FIG. 5 likewise shows that each hollow pillar 13 is traversed from one end to the other in the direction of its length by a rod tunnel 14 in which is housed a tie rod 17. As illustrated in zone D of said FIG. 5, the first rod end 18 of the tie rod 17 is secured to the transmission casing 8 by means of a first ball joint 42. Zone A of FIG. 5 for its part illustrates that the second rod end 19 is indirectly secured to the upper cylinder head 10 by means of a second ball joint 42.

In the sample embodiment of the double-acting pressure reducing cylinder 1 according to the invention as illustrated in FIGS. 1 to 5, the second rod end 19 of the tie rod 17 has a rod head 28 which maintains the cylinder shaft 71, the lower cylinder head 9 and the upper cylinder head 10 compressed together between said head 28 and the hollow pillar 13. This is made possible in particular thanks to fixation lugs 25 on said shaft 71 and said cylinder heads 9, 10, these lugs 25 having a lug opening 24 traversed by the second rod end 19. Zones B and C of FIG. 5 illustrate this arrangement in particularly obvious manner.

FIGS. 4 and 5 show that the first rod end 18 of the tie rod 17 is terminated—according to this nonlimiting sample embodiment—by a rod thread 29 screwed into a thread 27 disposed in a ball joint 42 which bears against the transmission casing 8 and about which said first end 18 is articulated.

Thus, the various ball joints 42 about which the four hollow pillars 13 are articulated and the tie rod 17 with which they cooperate allow the cylinder shaft 71, the lower cylinder head 9 and the upper cylinder head 10 to expand freely. However, this occur such that the hollow pillars 13 can transmit the traction and compression forces between the cylinder shaft 71, the lower cylinder head 9 and the upper cylinder head 10, on the one hand, and the transmission casing 8, on the other hand.

Yet it will be noted that this arrangement cannot operate without the lower centering means of the cylinder 20 and the upper centering means of the cylinder 21, each of which allows the cylinder shaft 71 to move freely in parallel with its longitudinal axis in relation to the transmission casing 8, yet prevents said shaft 71 from moving in the plane perpendicular to said axis, again in relation to said casing 8.

According to the nonlimiting sample embodiment of the double-acting pressure reducing cylinder 1 according to the invention which is illustrated in FIGS. 3 and 4, the centering and sealing plate 53 and the centering frame 22 which are rigidly integrated with the transmission casing 8 each carry respectively the lower centering means of the cylinder 20 and the upper centering means of the cylinder 21 said lower 20 and upper 21 means each being constituted by an elastic centering disk 63.

The elastic centering disk 63 which constitutes the lower centering means of the cylinder 20 is particularly visible in FIG. 6, while that which constitutes the upper centering means of the cylinder 21 is particularly visible in FIG. 7.

The elastic centering disks 63 have the function of ensuring the centering and the orientation with respect to the transmission casing 8 of the rigid assembly constituted by the cylinder shaft 71, the lower cylinder head 9 and the upper cylinder head 10.

To illustrate the functioning of the elastic centering disks 63, let us consider the one constituting the lower centering means of the cylinder 20 whose representation is particularly clear in FIG. 6.

One notes in this FIG. 6 that said disk 63 is fixed in tight manner by its disk fixation collar 65 to the centering and sealing plate 53 by means of eight fixation screws, which are numbered in FIG. 4.

One finds that said disk 63 is pierced at its center by a disk hole 64 through which passes the lower piston rod 46 without touching said disk 63, the edge of the disk hole 64 having a circular male contact pad 67 which is held in tight contact with the female centering and sealing cone 66 on the lower cylinder head 9. To ensure a tight contact between said pad 67 and said cone 66, the latter exerts a force on said pad 67 which deforms the elastic centering disk 63 axially and from its center as compared to its position of rest.

As can easily be inferred, the contact between the male conical shape of the contact pad 67 and the female conical shape of the centering and sealing cone 66 tends to center the lower cylinder head 9 on the centering and sealing plate 53. Moreover, said contact produces a seal which prevents the pressurized gases contained in the lower chamber of hot gases 11 from leaving that chamber 11.

When—principally under the effect of the temperature difference—the increase in the dimension of the assembly formed by the cylinder shaft 71, the lower cylinder head 9 and the upper cylinder head 10 is larger than that of the assembly formed by the transmission casing 8, the centering frame 22 and the rigid frame pillars 23, the pressure exerted by the female centering and sealing cone 66 of the lower cylinder head 9 on the male contact pad 67 increases, which deforms the elastic centering disk 63 somewhat more axially and from its center.

As the dimension differences in question only amount to tenths of millimeters, the axial deformation of the elastic centering disk 63 does not compromise the integrity of the latter, which is deformed in its range of elasticity. Moreover, the conical shape of the centering and sealing cone 66 and of the contact pad 67 accommodates the differential dilatations between these two parts 66, 67, whatever the direction of said dilatations.

It will be noted in FIG. 7 that the elastic centering disk 63 integrated with the centering frame 22 is designed to operate in similar fashion.

Thus, the lower centering means of the cylinder 20 and the upper centering means of the cylinder 21 cooperate to keep the cylinder shaft 71 always centered about the double-acting pressure reducing piston 2, and always parallel with the latter.

One notes in FIG. 6 the rod sealing means 55 which ensure the seal between the lower chamber of hot gases 11 and the lower piston rod 46 while ensuring the lubrication of the upper rod seal 56 and the lower rod seal 57 which are constituted by said means 55.

One notices that said means 55 also ensure the cooling of the lower piston rod 46 by means of an oil circulation chamber 58 into which empties a supply line for cooling and lubricating oil 59 and from which emerges an outlet line for cooling and lubricating oil 60. It is easy to notice that the flow of oil circulating between said lines 59, 60 is in permanent contact with the lower piston rod 46, so that said flow makes it possible to maintain that rod 46 at a temperature for example slightly higher than one hundred degrees Celsius, but not more elevated.

Again in FIG. 6 one notes that advantageously the upper rod seal 56 is constituted by two superposed sliced rings whose cuts are offset in angle, while the lower rod seal 57 is comprised of a single sliced ring, the two said seals 56, 57 being maintained at a distance from each other by a ring spacer spring 61 which has openings letting the flow of cooling and lubricating oil pass between the supply line for cooling and lubricating oil 59 and the outlet line for cooling and lubricating oil 60, via the oil circulation chamber 58.

FIG. 7 illustrates the same arrangement, the principal difference being that the ring spacing spring 61 gives way to a rod guide bushing 62 which ensures the radial guidance of the upper piston rod 47 which, in the nonlimiting example shown here to illustrate the operation of the double-acting pressure reducing cylinder 1 according to the invention, emerges into the pressure chamber 44 devised in the centering frame 22 and which we have seen can supply compressed air via an internal channel of the upper piston rod 47 to sealing means 48 such as a solid perforated ring 49 with a cushion of air, installed in a ring groove disposed in the periphery of the double-acting pressure reducing piston 2.

When the transfer/expansion and regeneration thermal engine taken here as a sample application is stopped, one notes that the oil pump supplying the oil circulation chambers 58 continues to supply the latter with oil to cool the lower piston rod 46 and the upper piston rod 47, while the lower cylinder head 9 and the upper cylinder head 10 continue to transmit heat to said chambers 58 and are liable to bring the oil contained in said chambers 58 up to the coking temperature.

Besides allowing for the free expansion of the rigid assembly formed by the cylinder shaft 71, the lower cylinder head 9 and the upper cylinder head 10, the particular configuration of the double-acting pressure reducing cylinder 1 according to the invention greatly limits the transfer of heat from the lower cylinder head 9 to the transmission casing 8. Keep in mind that such a transfer is detrimental to the efficiency of the transfer/expansion and regeneration thermal engine. Therefore, the hollow pillars 13 are not only of great length, as illustrated in FIGS. 1 to 5, but they are also preferably made of a material with low thermal conductivity, such as zirconium oxide.

In FIG. 5 one notes that, in order to allow for the use of a steel tie rod 17 which needs to remain at low temperature, each pillar comprises a rod cooling tube 30 surrounding in tight manner said tie rod 17 with which it cooperates, for the major portion of the length of said rod 17. A cooling fluid 31 coming from a source of cooling fluid 40 circulates in the space left free between the internal wall of said tube 30 and the outer surface of said rod 17, but the greatest possible portion of the outer surface of said tube 30 does not touch the internal wall of the rod tunnel 14 so as to define with this latter wall an empty space constituting a thermal insulation.

One notes in zone A of FIG. 5 that the rod cooling tube 30 has a tube bulge 35 which guarantees that said tube 30 remains locally centered in the rod tunnel 14. One further sees in zone D and in the vicinity of the first rod end 18 that two other tube bulges 35 each constitute both a centering and a sealing between said tube 30 and said tunnel 14. These two other bulges 35 cooperate with a constriction of tube diameter 36 which locally produces a seal between the rod cooling tube 30 and the tie rod 17.

One notes in FIG. 4 that the rod cooling tube 30 has a first tube feed opening 32 located between the two other bulges 35, said first opening 32 communicating with the inside of the rod cooling tube 30 in the vicinity of the first rod end 18 on the one hand, and being connected to the flow line of the source of cooling fluid 40 by means of channels arranged in the transmission casing 8, on the other hand.

In FIG. 4 and in FIG. 5 zone A, one notices that the rod cooling tube 30 terminates—in the area of the second rod end 19—in a tube collar 34 held tightly by the rod head 28 against a thermal insulation spacer 68 inserted between said collar 34 and the fixation lug 25 of the upper cylinder head 10. One also notices here that a Banjo fitting 38 is inserted between the rod head 28 and said collar 34, said fitting 38 having a radial connection line 39 connected to the return line of the source of cooling fluid 40, on the one hand, and communicating with the inside of the rod cooling tube 30 on the other hand via the end of the rod cooling tube 30 receiving the tube collar 34.

It will be understood that the thermal insulation spacer 68—preferably made of zirconium oxide—constitutes an additional obstacle to the transfer of heat from the upper cylinder head 10, brought up to around nine hundred degrees Celsius, to the rod head 28, maintained at only a hundred degrees Celsius.

In any case, this particular configuration which makes it possible to cool the tie rod 17 is of no use if the latter is made of material resistant to high temperatures, such as "zircon", silicon carbide, aluminum, or any superalloy specifically developed for this type of use.

In FIGS. 6 and 7 one will have noticed the relatively large radial length left on the elastic centering disk 63 between its disk fixation collar 65 and its contact pad 67. While this length is necessary in order for said disk 63 to be axially deformed from its center, it is also useful in limiting as much as possible the transfer of heat from the centering and sealing cone 66 to said collar 65. For this purpose, the body of the elastic centering disk 63 is preferably of slight thickness and made of zirconium oxide, known for its low thermal conductivity. One will also note that the linear contact of slight width between the centering and sealing cone 66 and the contact pad 67 likewise constitutes in itself an advantageous thermal barrier.

The possibilities of the double-acting pressure reducing cylinder 1 according to the invention are not limited to the applications just described and it should furthermore be understood that the preceding description has been given only as an example and that it in no way limits the scope of said invention, which shall not be done by replacing the described details of the embodiment by any other equivalent.

The invention claimed is:

1. Double-acting pressure reducing cylinder (1) with adaptive support comprising a cylinder shaft (71), cooperating with a double-acting pressure reducing piston (2) which is connected by a lower piston rod (46) to means of transmission (3) installed in a transmission casing (8) to which the cylinder shaft (71) is secured, while the end of said shaft (71) which emerges from the side of said means (3) is closed by a lower cylinder head (9) through which the lower piston rod (46) passes via a lower rod opening (51) to define with the double-acting pressure reducing piston (2) a lower chamber of hot gases (11), while the other end of said shaft (71) is closed by an upper cylinder head (10) to define with said piston (2) an upper chamber of hot gases (12), wherein the double-acting pressure reducing cylinder comprises:

at least one hollow pillar (13) through which passes entirely in the direction of its length a rod tunnel (14), a first pillar end (15) of said pillar (13) resting directly or indirectly on the transmission casing (8), while a second pillar end (16) of said pillar (13) directly or indirectly supports the cylinder shaft (71), the lower cylinder head (9) and the upper cylinder head (10), while said first end (15) can pivot about a ball joint (42) and/or bend in relation to said casing (8), while said second end (16) can pivot about said ball joint (42) and/or bend in relation to said cylinder shaft (71);

at least one tie rod (17), installed in the rod tunnel (14), a first rod end (18) of said tie rod (17) being directly or indirectly secured to the transmission casing (8), while a second rod end (19) of said tie rod (17) is secured to the cylinder shaft (71) and/or to the lower cylinder head (9) and/or to the upper cylinder head (10), said first end (18) being able to pivot about said ball joint (42) and/or bend in relation to said casing (8), while said second end (19) can pivot about said ball joint (42) and/or bend in relation to said cylinder (1);

lower cylinder centering means (20) positioned near the lower cylinder head (9), said means (20) bearing against the cylinder shaft (71) or the lower cylinder head (9), on the one hand, and directly or indirectly against the transmission casing (8) on the other hand, and said means (20) leaving the cylinder shaft (71) free to move in parallel with its longitudinal axis in relation to the transmission casing (8), yet preventing said shaft (71) from moving in the plane perpendicular to said axis, again with respect to said casing (8);

upper cylinder centering means (21) positioned near the upper cylinder head (10), said means (21) bearing against the cylinder shaft (71) or the upper cylinder head (10), on the one hand, and against a centering frame (22) rigidly fixed to the transmission casing (8) and maintained at a height near that of the upper cylinder head (10) by at least one rigid frame pillar (23), on the other hand, said means (21) leaving the cylinder shaft (71) free to move in parallel with its longitudinal axis in relation to the transmission casing (8), yet preventing said shaft (71) from moving in the plane perpendicular to said axis, again with respect to said casing (8).

2. Double-acting pressure reducing cylinder according to claim 1, further comprising at least one rod cooling tube (30) which tightly surrounds the tie rod (17) for all or part of the length of said rod (17), a cooling fluid (31) coming from a source of cooling fluid (40) being able to circulate in a space left free between the internal wall of said tube (30) and the outer surface of said rod (17), while the largest possible portion of the outer surface of said tube (30) does not touch the internal wall of the rod tunnel (14) so as to define with the latter wall an empty space.

3. Double-acting pressure reducing cylinder according to claim 2, further comprising at least one first tube feed opening (32) which communicates with the interior of the rod cooling tube (30) in the vicinity of the first rod end (18), and/or at least one second tube feed opening (33) which communicates with the interior of the rod cooling tube (30) in the vicinity of the second rod end (19), the cooling fluid (31) being able to circulate between the two said openings (32, 33).

4. Double-acting pressure reducing cylinder according to claim 2, wherein the rod cooling tube (30) has a tube collar (34) held directly or indirectly clamped by the tie rod (17) either against a fixation lug (25) on the cylinder shaft (71) or the upper cylinder head (10), or against the transmission casing (8).

5. Double-acting pressure reducing cylinder according to claim 4, wherein the tube collar (34) is held clamped by the tie rod (17) against the fixation lug (25) by means of a Banjo fitting (38), which has at least one radial connection conduit (39) connected to the source of cooling fluid (40) on the one hand, and communicating with the interior of the rod cooling tube (30) on the other hand.

6. Double-acting pressure reducing cylinder according to claim 4, wherein a thermal insulation spacer which (68) is inserted between the tube collar (34) and the fixation lug (25), said spacer (68) being traversed from one end to the other in the direction of its length by a spacer tunnel (69) in which is installed the tie rod (17) and the rod cooling tube (30) which surrounds it in tight manner, while the largest possible portion of the outer surface of said tube (30) does not touch the internal wall of the spacer tunnel (69) so as to define with the latter wall an empty space.

7. Double-acting pressure reducing cylinder according to claim 2, wherein the rod cooling tube (30) has at least one tube bulge (35) constituted by an axial portion of said tube (30) whose diameter is essentially equivalent to or slightly greater than that of the rod tunnel (14) in which it is installed.

8. Double-acting pressure reducing cylinder according to claim 2, wherein the rod cooling tube (30) has at least one constriction of tube diameter (36) constituted by an axial portion of said tube (30) whose diameter is essentially equivalent to or slightly less than that of the body of the tie rod (17).

9. Double-acting pressure reducing cylinder according to claim 2, wherein the rod cooling tube (30) has at least one radial communication hole (37) which allows the cooling fluid (31) to enter said tube (30), or to exit from it.

10. Double-acting pressure reducing cylinder according to claim 1, wherein the tie rod (17) is hollow to form an internal rod cooling channel disposed in the length of said rod (17), said channel emerging axially or radially from said rod (17), while a cooling fluid (31) coming from a source of cooling fluid (40) can circulate in said channel (41).

11. Double-acting pressure reducing cylinder according to claim 1, wherein a pressure chamber (44) connected to a source of pressurized air (45) is secured to the centering frame (22) or disposed on or in the latter, while an upper piston rod (47) which prolongs the double-acting pressure reducing piston (2) on the side of the upper chamber of hot gases (12) passes through the upper cylinder head (10) via an upper rod opening (43) disposed in said cylinder head (10) and via an access opening to the chamber (52) passing through the centering frame (22) to emerge in the pressure chamber (44) such that the end of said rod (47) which is furthest away from said piston (2) always remains plunged inside said chamber (44) regardless of the position of said piston (2).

12. Double-acting pressure reducing cylinder according to claim 11, wherein the access opening to the chamber (52) cooperates with—or comprises—rod sealing means (55) which provide a seal between said opening (52) and the upper piston rod (47).

13. Double-acting pressure reducing cylinder according to claim 12, wherein the rod sealing means (55) include an upper rod seal (56) and a lower rod seal (57) sufficiently distant from each other to form—between the two said seals (56, 57)—an oil circulation chamber (58) into which empties a conduit for supply of cooling and lubricating oil (59) and from which emerges an outlet conduit for cooling and lubricating oil (60).

14. Double-acting pressure reducing cylinder according to claim 13, wherein the rod sealing means (55) cooperate with a rod guide bushing (62) installed inside or outside of the oil circulation chamber (58).

15. Double-acting pressure reducing cylinder according to claim 1, wherein the transmission casing (8) is topped by a centering and sealing plate (53), pierced by an access opening to the means of transmission (54) through which passes the lower piston rod (46) in order to be connected to the means of transmission (3), said plate (53) being rigidly fixed to said casing (8).

16. Double-acting pressure reducing cylinder according to claim 15, wherein the access opening to the means of transmission (54) cooperates with—or comprises—rod sealing means (55) which provide a seal between said opening (54) and the lower piston rod (46).

17. Double-acting pressure reducing cylinder according to claim 16, wherein the rod sealing means (55) include an upper rod seal (56) and a lower rod seal (57) sufficiently distant from each other to form—between the two said seals (56, 57)—an oil circulation chamber (58) into which empties a conduit for supply of cooling and lubricating oil (59) and from which emerges an outlet conduit for cooling and lubricating oil (60).

18. Double-acting pressure reducing cylinder according to claim 15, wherein the centering and sealing plate (53) carries the lower centering means of the cylinder (20), which are comprised of an elastic centering disk (63) whose periphery forms a disk fixation collar (65), secured in tight manner to said plate (53), said disk (63) being pierced at its center by a disk hole (64) through which passes the lower piston rod (46) without touching said disk (63), the edge of the disk hole (64) having a circular contact pad (67) which is maintained in tight contact with a centering and sealing cone (66) on the lower cylinder head (9), said cone (66) being either male or female, and the contact between said pad (67) and said cone (66) having the effect of deforming the elastic centering disk (63) axially and from its center.

19. Double-acting pressure reducing cylinder according to claim 1, wherein the lower centering means of the cylinder (20) and/or the upper centering means of the cylinder (21) are comprised by an elastic centering disk (63) which can be pierced at its center by a disk hole (64) through which passes, respectively, the lower piston rod (46) or an upper piston rod (47), while its periphery is comprised of a disk fixation collar (65) secured in tight manner respectively to the transmission casing (8) and/or to the centering frame (22).

20. Double-acting pressure reducing cylinder according to claim 1, wherein the upper centering means of the cylinder (21) are comprised of an elastic centering disk (63) whose periphery forms a disk fixation collar (65), secured in tight manner to the centering frame (22), said disk (63) being pierced at its center by a disk hole (64) whose edge has a circular contact pad (67) which is maintained in tight contact with a centering and sealing cone (66) on the upper cylinder head (10), said cone (66) being either male or female, and the contact between said pad (67) and said cone (66) having the effect of deforming the elastic centering disk (63) axially and from its center.

* * * * *